US008984990B2

(12) United States Patent
Broadaway et al.

(10) Patent No.: US 8,984,990 B2
(45) Date of Patent: Mar. 24, 2015

(54) LOCKABLE GRIP WRENCH

(71) Applicant: Apex Brands, Inc., Sparks, MD (US)

(72) Inventors: Eric Broadaway, New Freedom, PA (US); Yongsheng Xu, Shanghai (CN); Fengping Zhu, Shanghai (CN); Zhihong Fu, Shanghai (CN)

(73) Assignee: Apex Brands, Inc., Apex, NC (US)

( * ) Notice: Subject to any disclaimer, the term of this patent is extended or adjusted under 35 U.S.C. 154(b) by 228 days.

(21) Appl. No.: 13/858,296

(22) Filed: Apr. 8, 2013

(65) Prior Publication Data

US 2013/0263705 A1 Oct. 10, 2013

Related U.S. Application Data

(60) Provisional application No. 61/621,635, filed on Apr. 9, 2012.

(51) Int. Cl.

| | |
|---|---|
| ***B25B 13/24*** | (2006.01) |
| ***B25B 13/18*** | (2006.01) |
| ***B25B 7/14*** | (2006.01) |
| ***B25B 13/12*** | (2006.01) |
| ***B25B 13/20*** | (2006.01) |
| ***B25B 27/14*** | (2006.01) |

(52) U.S. Cl.

CPC . *B25B 7/14* (2013.01); *B25B 13/12* (2013.01); *B25B 13/20* (2013.01); *B25B 27/146* (2013.01)

USPC ..... 81/90.9; 81/90.2

(58) Field of Classification Search

CPC ..... B25B 13/00; B25B 13/18; B25B 13/20; B25B 13/24; B25B 13/28; B25B 7/14

USPC ..... 81/90.3, 90.9, 347–350

See application file for complete search history.

(56) References Cited

U.S. PATENT DOCUMENTS

| | | | | |
|---|---|---|---|---|
| 599,837 | A * | 3/1898 | William | 81/90.3 |
| 2,787,925 | A | 4/1957 | Buchanan et al. | |
| 3,713,322 | A | 1/1973 | Fischer | |
| 5,261,263 | A * | 11/1993 | Whitesell | 72/409.19 |
| 6,889,579 | B1 | 5/2005 | Brown | |
| 7,748,298 | B2 | 7/2010 | Brown | |
| 7,992,470 | B2 | 8/2011 | Brown | |
| 2010/0089206 | A1 | 4/2010 | Brown | |

* cited by examiner

*Primary Examiner* — David B Thomas

(74) *Attorney, Agent, or Firm* — Coats & Bennett, PLLC

(57) ABSTRACT

A wrench includes a locking mechanism that provides variable locking positions. The wrench has handles that are rotatably connected such that a closing motion of the handles allows the wrench to grip workpieces as desired by moving a plurality of jaw elements inward toward the workpiece. The locking mechanism advantageously allows the jaws and handles of the wrench to be locked precisely on any size workpiece within the working range of the wrench. Related methods are also described.

19 Claims, 7 Drawing Sheets

LOCKABLE GRIP WRENCH

This application claims the benefit of U.S. Provisional Application No. 61/621,635, filed 9 Apr. 2012, the entire disclosure of which is incorporated herein by reference.

BACKGROUND

The present invention relates to hand wrenches, such as for tightening or loosening fasteners.

Numerous wrenches are known in the art. For example, a conventional box end wrench typically has two faceted openings, one on each end, for receiving a faceted fastener, such as a conventional hexagonal nut. Such box end wrenches typically require that the wrench be repositioned numerous times to rotate the nut to the desired position, which is cumbersome. As such, ratcheting box end wrenches have been developed that allow for easier use. However, even ratcheting box end wrenches are designed for a specific size, or a very limited range of sizes, of nuts. Therefore, multiple ratcheting box end wrenches are required for jobs with multiple sizes of nuts. And, conventional ratcheting box end wrenches may be unsuited to some types of fasteners, such as TORX brand fasteners.

Other known wrenches include relatively pivoting handles and provide for the nut to be gripped by moving multiple jaw elements inward in response to closing together of the handles. For example, U.S. Pat. No. 2,787,925 shows such a wrench, sometimes referred to as a grip wrench. However, the Buchannan tool requires that the user manually hold the handles together against spreading when applying torque to the nut. As such, the torque applied to the fastener by the Buchannan tool may be limited by the user's grip strength, which may be insufficient in some situations.

Thus, while the prior art wrenches may be suitable for some situations, they may not be suitable for all situations. Accordingly, there remains a need for alternative wrenches, particularly variable-size wrenches that provide secure gripping.

SUMMARY

Described below are one or more embodiments of a wrench having a locking mechanism that is designed to work with workpieces that are sizes anywhere in a working size range of the wrench, and related methods.

In one or ore embodiments, a locking grip wrench is provided. The wrench includes first and second handles. The first handle has a first grip section and a first working section. The second handle has second grip section and a second working section. The second handle is rotatably mounted to the first handle such that the first and second working sections overlap and the first and second handles are rotatable relative to each other about a first axis. The wrench has a workpiece-receiving opening extending through the first and second handles and disposed about the first axis. The wrench has a plurality of jaw elements disposed about the first axis in spaced relation to each other and movable toward and away from the first axis. The jaw elements are movable toward and away from the first axis in response to movement of the first and second grip sections toward and away from each other, respectively. The wrench has a lock mechanism. The lock mechanism includes a lock element and an actuator. The lock element is movably disposed in the first handle. The actuator is mounted for rotational movement about the first axis and has a peripheral cam surface eccentrically disposed relative to the first axis and selectively engagable against a lock element. The wrench is configured such that a spacing between the jaw elements is variably controlled based on a rotational position of the actuator relative to the first axis.

In one or more embodiments, the locking grip wrench has first and second handles. The first handle has a first grip section and a first working section. The second handle has a second grip section and a second working section. The second handle is rotatably mounted to the first handle such that the first and second working sections overlap and the first and second handles are rotatable relative to each other about a first axis. The wrench has a workpiece-receiving opening extending through the first and second handles and peripherally surrounding the first axis. The first handle has a plurality of arcuate first guide slots disposed about the workpiece-receiving opening and outboard thereof. The first handle also has a first lock slot disposed in spaced relation to the workpiece-receiving opening. The second handle has a plurality of outwardly extending second guide slots oriented toward the workpiece-receiving opening. The second handle also has a second lock slot disposed in spaced relation to the workpiece-receiving opening. A plurality of jaw elements are disposed about the first axis in spaced relation to each other. The jaw elements are movable in the second guide slots toward and away from the first axis in response to movement of the first and second grip sections toward and away from each other, respectively, such that movement of the first and second grip sections toward each other causes the jaw elements to be displaced toward the first axis, while movement of the first and second grip sections away from each other causes the jaw elements to be displaced away from the first axis. The wrench includes a lock mechanism having a lock element and an actuator. The lock element is disposed generally parallel to the first axis and movably disposed in the first and second lock slots. The lock slots are distinct from the guide slots. The actuator is selectively engagable against the lock element at a plurality of positions. The wrench is configured such that a spacing between the jaw elements is variably controlled based on a position of the actuator.

In one or more embodiments, the locking grip wrench has first and second handles. The first handle has a first grip section and a first working section. The second handle has a second grip section and a second working section. The second handle is rotatably mounted to the first handle such that the first and second working sections overlap and the first and second handles are rotatable relative to each other about a first axis. A workpiece-receiving opening extends through the first and second handles with the first axis extending through the workpiece-receiving opening. A plurality of jaw elements are disposed about the first axis in spaced relation to each other and movable toward and away from the first axis. The jaw elements are movable toward and away from the first axis in response to movement of the first and second grip sections toward and away from each other, respectively. A lock mechanism includes a lock element and an actuator. The lock element is movably disposed in both a lock slot of the first handle and a lock slot of the second handle. The actuator is moveable relative to the lock element and the first and second handles, and the actuator has a cam surface. With the actuator in a locking position, the cam surface limits movement of the lock element toward the first axis to thereby limit movement of the jaw elements away from the from the first axis.

In one or more embodiments, a method of operating a manually-powered locking grip wrench includes moving grip sections of first and second handles toward each other to cause a plurality of jaw elements mounted in the handles to move toward an axis about which the first and second handles rotate relative to each other. The method also includes establishing a limit of movement of a plurality of jaw elements in a direction away from the axis by rotating a lock actuator about the axis to a locking position; wherein, in the locking position, a cam surface of the locking actuator is positioned in the path of a movable locking pin with the locking pin extending into both the first and second handles. The method may also include applying torque to a workpiece by rotating the wrench about the axis while the lock actuator is in the locking position. The rotating the lock actuator to the locking position may comprise abutting a cam surface against the locking pin. In some embodiments, the second handle comprises a lock slot along which the locking pin is slidable, and the rotating the lock actuator to the locking position comprises positioning the lock actuator so as to inhibit movement of the locking pin along the lock slot toward the axis beyond the cam surface.

The various aspects of the devices and methods discussed above may be used alone or in any combination. Further, the present invention is not limited to the above features and advantages. Indeed, those skilled in the art will recognize additional features and advantages upon reading the following detailed description, and upon viewing the accompanying drawings.

DETAILED DESCRIPTION

In one or more embodiments, the present application is directed to a wrench that includes a locking mechanism that provides variable locking positions and/or related methods. The wrench has handles that are rotatably connected such that a closing motion of the handles allows the wrench to grip workpieces as desired by moving a plurality of jaw elements inward toward the workplace. The locking mechanism advantageously allows the jaws and handles of the wrench to be locked precisely on any size workpiece within the working range of the wrench. For simplicity, a nut will be used as an illustrative workpiece in the discussion below; however, it should be understood that other fasteners, and indeed other workpieces, may alternatively be gripped by the wrench.

Figure 1:
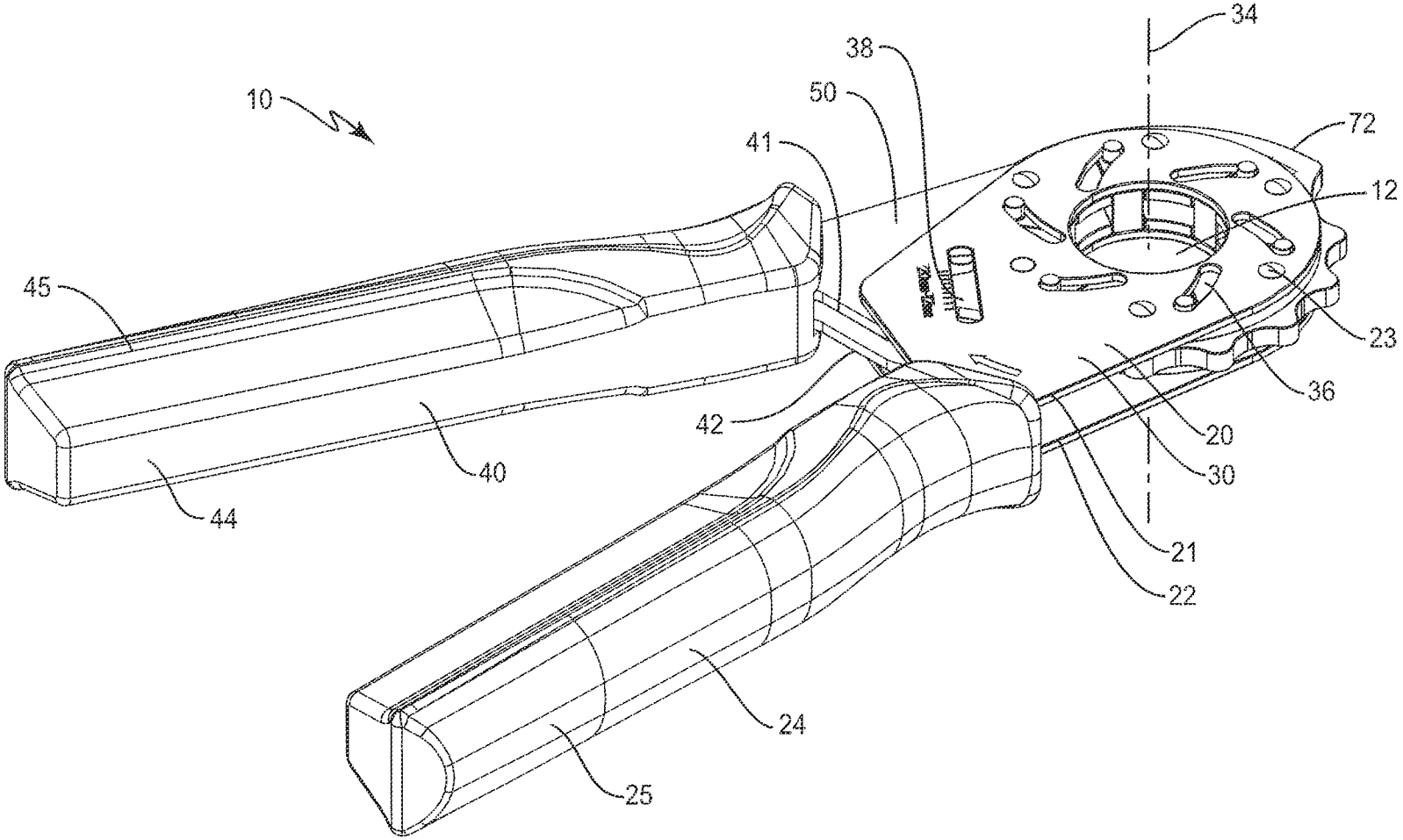
FIG. 1 shows a perspective view of a wrench according to one embodiment.

The wrench of FIG. 1, generally indicated at 10, includes a right handle assembly 20, a left handle assembly 40, a plurality of jaw elements 60, and a locking mechanism 70. As further detailed in FIGS. 2-3, the right handle assembly 20 (sometimes referred to simply as the right handle) includes a grip section 24 toward one end and a working section 30 toward the opposing end. The head or working section 30 includes an opening 32 therethrough, which may be circular or otherwise in shape. For the illustrated embodiment, the opening 32 is peripherally disposed about an axis 34. The working section 30 also includes a plurality of curved guide slots 36 which are disposed in spaced relation to opening 32. The guide slots 36 advantageously have a consistent radius of curvature, both along a given guide slot 36 and from guide slot 36 to guide slot 36. The working section 30 also includes a lock slot 38, which is advantageously straight and disposed at a transverse angle to the grip section 24. The right handle 20 is advantageously formed primarily of metal for strength, but the grip section 24 may optionally include an outer plastic grip element 25 for improved ergonomic feel. The working section 30 of the right handle 20 may be formed of a single unitary member, but is advantageously formed of an upper plate 21 and a lower plate 22 that are substantially identical and joined together by suitable means, such as by a plurality of spaced apart rivets 23.

Figure 2:
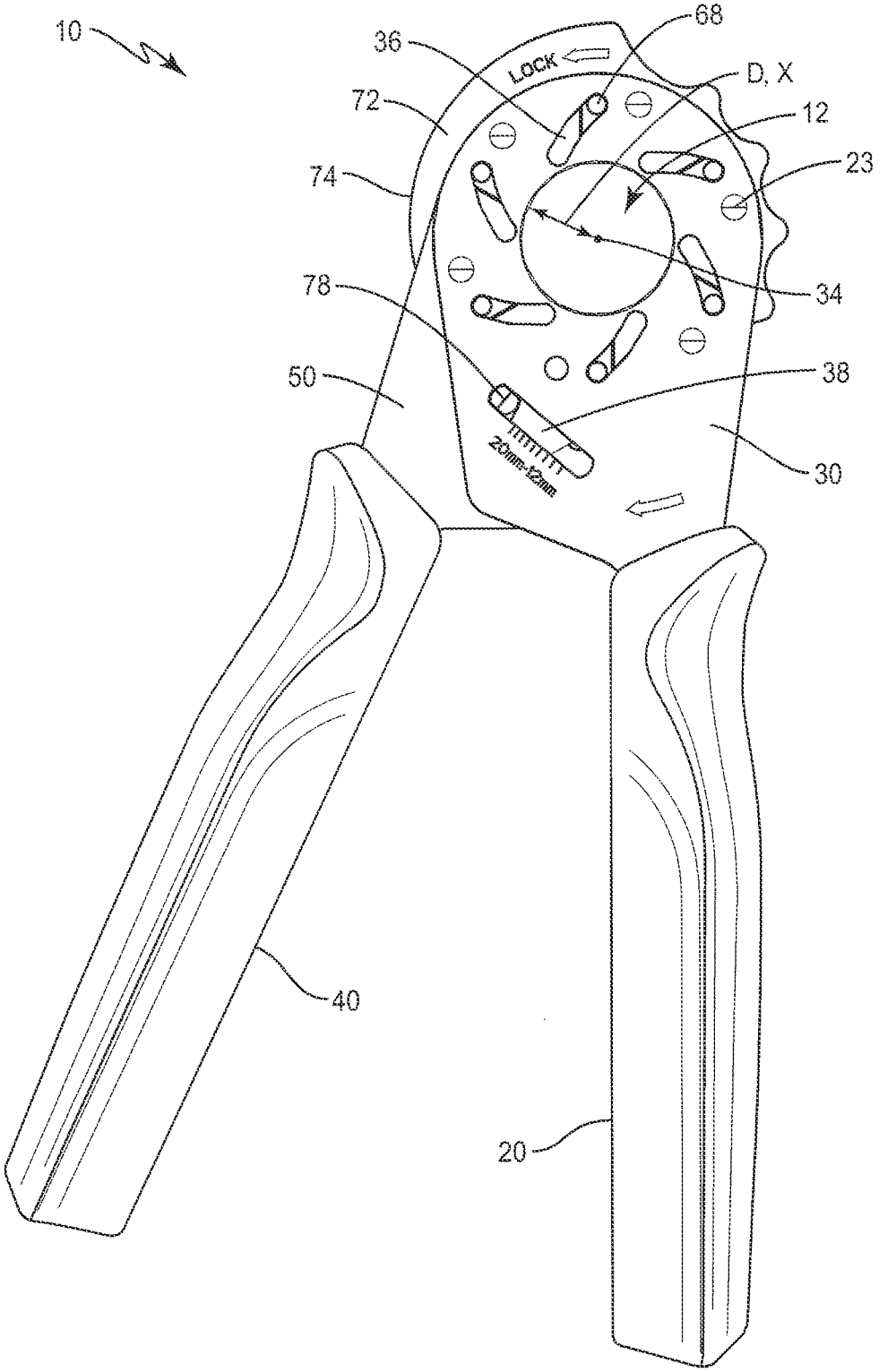
FIG. 2 shows a front view of the wrench of FIG. 1, in the fully open and unlocked configuration.
Figure 3:
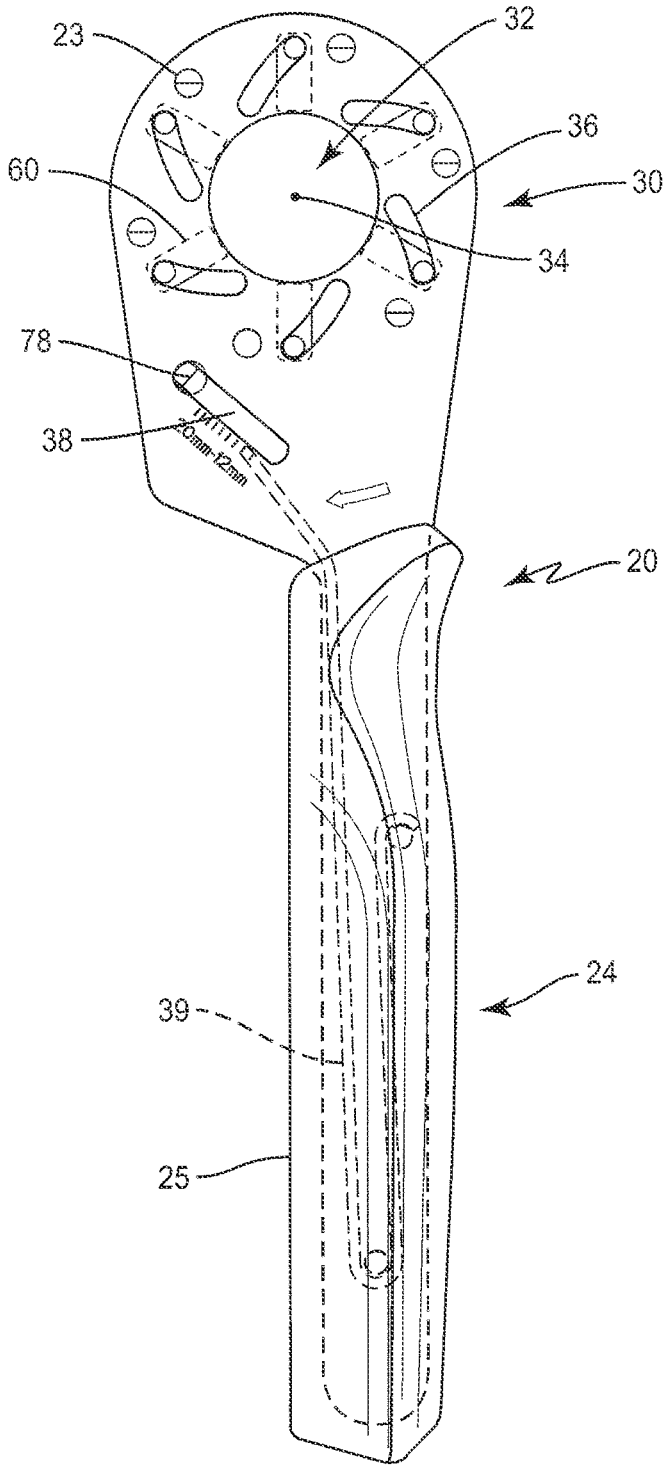
FIG. 3 shows the wrench of FIG. 2 with the left handle and lock actuator removed for clarity.
Figure 4:
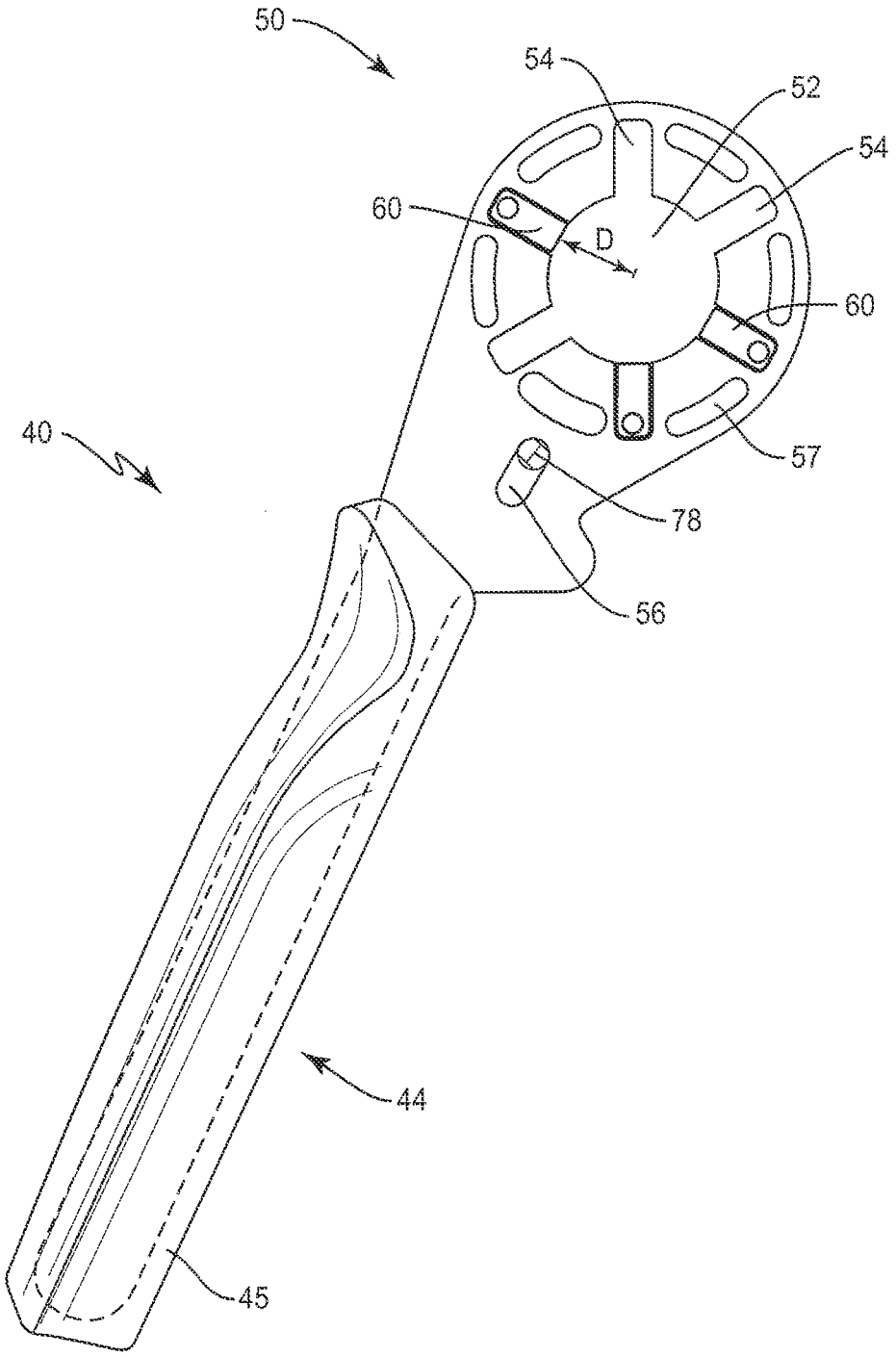
FIG. 4 shows the wrench of FIG. 2 with the right handle, lock actuator, and some jaw elements removed for clarity.

Referring to FIG. 1, FIG. 2, and FIG. 4, the left handle assembly 40 (sometimes referred to simply as the left handle) is rotatably mounted to the right handle 20, with relative rotation therebetween being about axis 34. The left handle 40 includes a grip section 44 toward one end and a working section 50 toward the opposing end. The head or working section 50 includes a main opening 52 therethrough, which may be circular or otherwise in shape. For the illustrated embodiment, the main opening 52 is peripherally disposed about axis 34, so that opening 32 and opening 52 overlap, forming opening 12. The working section 50 also includes a plurality of guide slots 54 that open onto opening 52. The guide slots 54 are disposed in spaced relation to each other, and are advantageously straight. The working section 50 also includes a lock slot 56, which is advantageously straight and disposed generally parallel to the grip section 44. Thus, lock slot 56 and lock slot 38 are disposed transversely to each other. In addition, the left handle 40 includes a plurality of curved clearance slots 57, through which some of rivets 23 extend. Like the right handle 20, the left handle 40 is advantageously formed primarily of metal for strength, but the grip section 44 may optionally include an outer plastic grip element 45 for improved ergonomic feel. The working section 50 of the left handle 40 may be formed of a single unitary member, but is advantageously formed of an upper plate 41 and a lower plate 42 that are substantially identical and joined together by suitable means, such as by rivets (not shown, hidden by grip element 45).

Figure 5:
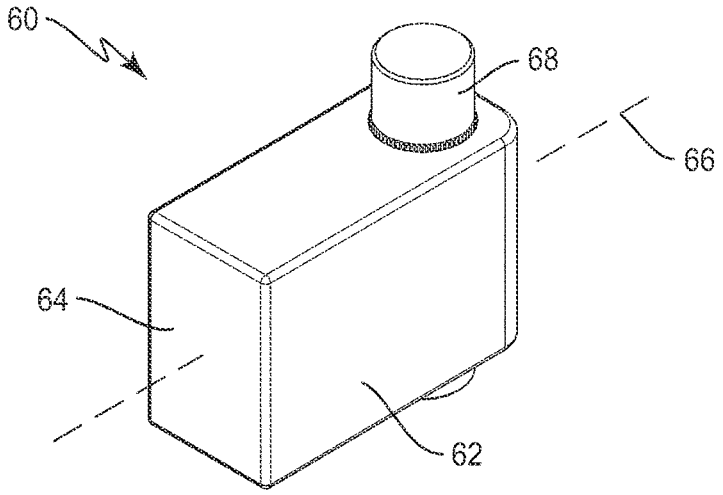
FIG. 5 shows a perspective view of a jaw element.

The jaw elements 60 are moveably disposed in the working sections 30,50 of handles. Referring to FIG. 5, the jaw elements 60 include a main body 62 and a guide element 68. The main body 62 may be generally block-like, and is slidably disposed in the corresponding slot 54. The inward tip 64 of the main body 62 may be flat or may have another profile, such as rounded, as is desired. The guide elements 68 may be formed by a suitable pin that is fixed to extend through the main body. The pin 68 advantageously has a round cross-section, although other suitable shapes may alternatively be employed. The pin 68 is advantageously disposed perpendicular to the longitudinal axis 66 of the main body 62, and advantageously extends out beyond the main body 62 in both directions parallel to axis 34. Travel of the pin 68 in the corresponding guide slot(s) 36 controls the in/out movement of jaw element 60, and thus the location of the jaw element 60 relative to axis 34. Forces generated by moving the grip sections 24,44 of handles 20,40 toward or away from each other are transmitted to the bodies 62 via the interaction of pins 68 and slots 36, and bodies 62 and slots 54, to move the jaw elements 60 toward or away from axis 34.

Figure 6:
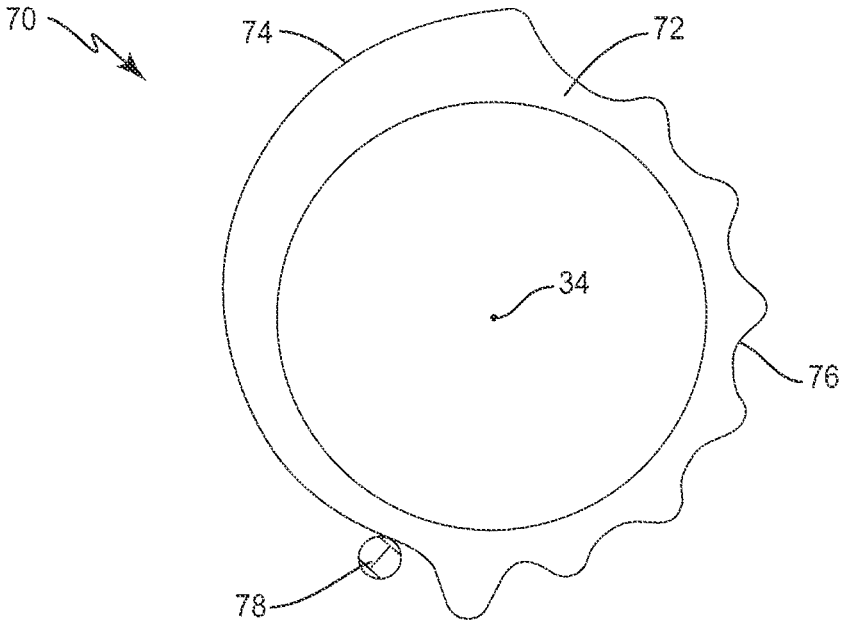
FIG. 6 shows a front view of a lock mechanism, showing the actuator and the lock pin.
Figure 7:
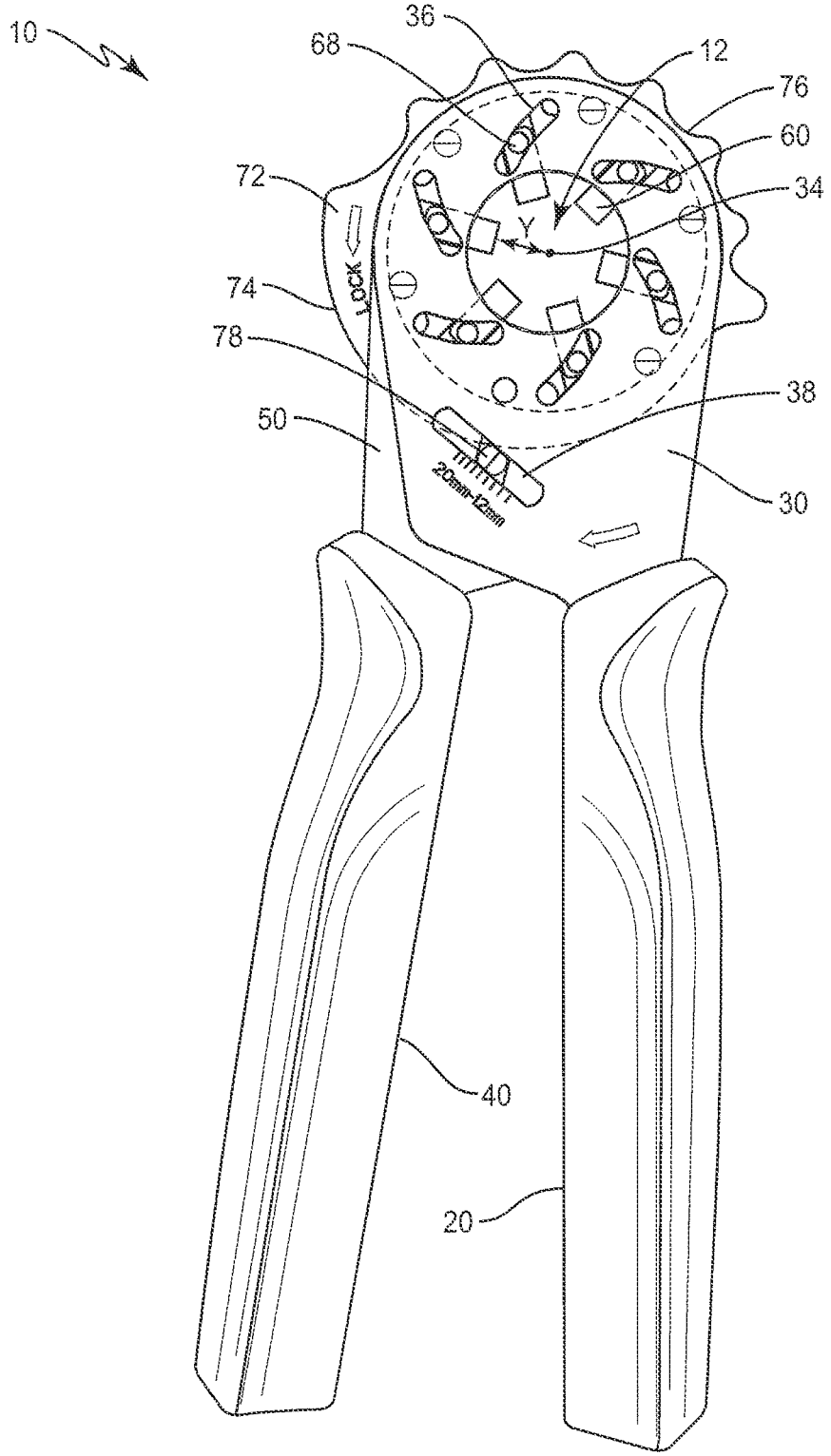
FIG. 7 shows a front view of the wrench of FIG. 2, in a partially closed and locked configuration.
Figure 8:
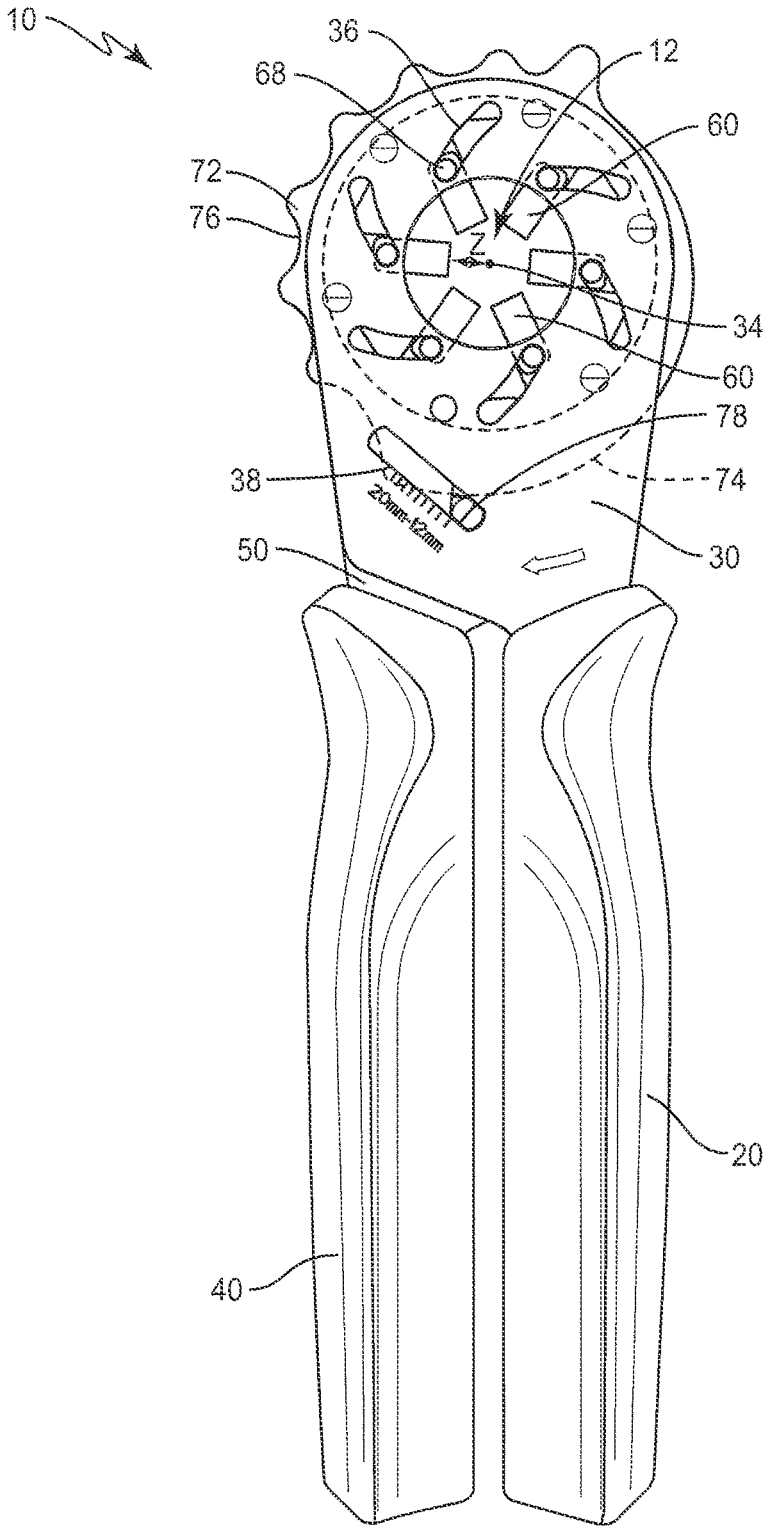
FIG. 8 shows a front view of the wrench of FIG. 2, in a fully closed and locked configuration.

Referring to FIG. 6, the locking mechanism 70 includes an actuator 72 and a locking element 78. The locking element 78 is slidably disposed in both lock slot 38 and lock slot 56. The locking element 78 is typically a metal pin, and is therefore sometimes referred to as the locking pin. The actuator 72 is rotatably mounted to the wrench 10 for rotation about axis 34. The actuator 72 advantageously takes the form of a ring having an outer cam surface 74. The cam surface 74 is eccentrically disposed relative to axis 34 so that the various portions of cam surface 74 extend outward varying distances from axis 34. In addition, the actuator 72 may include suitable finger engaging features 76 (e.g., a scalloped outer surface, knurling, etc.) disposed generally opposite the cam surface 74. The actuator 72 is rotatable about axis 34 between an unlocked position (FIG. 2) and a plurality of locked positions (FIGS. 7-8). The actuator 72 is disposed outboard of the outermost portion of guide slots 54 and the corresponding jaw elements 60 (and any relevant rivets 23), so that rotation of the actuator 72, at least in the unlocking direction, is not inhibited. As explained further below, the actuator 72, in a locking position, defines a limit of inward movement of the locking pin 78 along lock slot 56 toward axis 34, and this limit may be variably set based on the rotational position of the actuator 72. Further, in the illustrated embodiment, the actuator 72 is disposed both between the grip section 24 and axis 34 and opposite grip section 24 relative to axis 34, in both the unlocked and the locked positions.

The wrench 10 may grip the nut by placing the nut in opening 12, and then squeezing the grip sections 24,44 toward each other. As the handles 20,40 rotate about axis 34, the working sections 30,50 of the handles 20,40 are rotated relative to each other about axis 34. This rotation causes the pins 68 of jaw elements 60 to travel in the arcuate guide slots 36, which in turn causes the bodies 62 of the jaw elements 60 to slide inward along slots 52. Thus, the jaw elements 60 are displaced inward when the grip sections 24,44 of the handles 20,40 are rotated toward each other. The inward displacement of the jaw elements 60 brings the tips 64 of the jaw elements 60 into contact with the corresponding facets of the nut's outer surface, thereby gripping the nut. Note that there are advantageously six jaw elements 60, disposed at regular 60° intervals about axis 34, so that each jaw element 60 presses against a corresponding facet of a conventional hexagonal nut. If gripping the nut to tighten it on a threaded rod, the nut is then turned, and the handles 20,40 released. An optional spring 39 biases the handles 20,40 so that the grip sections 24,44 are spread apart. If additional tightening is needed, the handles 20,40 are again squeezed, and additional torque applied.

In many situations, a user's grip strength is sufficient to hold the handles 20,40 together (toward the closed configuration with the jaw elements 60 displaced inward) during the tightening. However, in some situations, the handles 20,40 may tend to open despite the user's grip. To counter this, the actuator 72 of the locking mechanism 70 may be rotated (counter-clockwise in FIG. 2) to a locking position (FIG. 7) when the wrench 10 is gripping the nut, but before significant torque is applied. The actuator 72 is rotated until the cam surface 74 abuts the locking pin 78. With this engagement, the locking pin 78 is prevented from moving inward toward the axis 34. Due the interaction of the locking pin 78 and lock slots 38,56 this means that the handles 20,40 are prevented from moving outward beyond this point of engagement. Note that the handles 20,40 may still be moved inward if there were not a nut abutting the jaw elements 60. Thus, the wrench 10 is locked against opening by the locking mechanism 70, not by the user's grip strength. The user may then pull on the handles 20,40 in the desired direction to apply the torque to the nut. Note that with the wrench 10 in a locked configuration, the torque can be applied in either direction. To open the wrench 10, the lock actuator 72 is simply rotated in the opposite direction, thereby allowing the jaw elements 60 to open further.

In the locked configuration (FIG. 7), the jaw elements 60 are prevented from moving outward more than a maximum amount. That is, a distance D from the tip 64 of a given jaw element 60 to the axis 34 is limited to a maximum amount set by the rotational position of the actuator 72. Thus, with the actuator 72 in the open/unlocked rotational position (FIG. 2), the maximum distance from the jaw element 60 to axis 34 is X. Note that for symmetrically disposed jaw elements 60, this means that the maximum distance between jaw elements 60 is 2X, and for non-symmetrically disposed jaw elements 60 the maximum distance is ≤2X. With the actuator 72 rotated to a locked position, the maximum distance is Y, which is less than X. Further, due to the contour of cam surface 74, relative to axis 34, the distance limit is variably selectable by the user. Thus, with the wrench in a further locked configuration (such as fully closed configuration of FIG. 8) where actuator 72 further rotated, the maximum distance may be Z, which is less than Y. Because the distance limit is related to the travel of locking pin 78 along lock slot 36, suitable size indicia may advantageously be included proximate lock slot 36, so that the user may easily see the selected maximum size.

The discussion above has been in the context of the wrench 10 having six jaw elements 60 disposed at regular intervals. Such an arrangement is believed advantageous. However, the wrench 10 may include an even number or an odd number of jaw elements 60, as is desired. Thus, in an un-illustrated embodiment, the wrench includes three jaw elements 60, spaced from each other at 120° intervals about axis 34. Further, the jaw elements 60 may be regularly spaced or irregularly spaced about axis 34.

The disclosure of any U.S. patents or patent application publications mentioned above are incorporated herein in their entirety.

The present invention may, of course, be carried out in other ways than those specifically set forth herein without departing from essential characteristics of the invention. The present embodiments are to be considered in all respects as illustrative and not restrictive, and all changes coming within the meaning and equivalency range of the appended claims are intended to be embraced therein.

What is claimed is:

1. A lockable grip wrench, comprising:

a first handle having a first grip section and a first working section;

a second handle having a second grip section and a second working section; the second handle rotatably mounted to the first handle such that the first and second working sections overlap and the first and second handles are rotatable relative to each other about a first axis;

a workpiece-receiving opening extending through the first and second handles and disposed about the first axis;

a plurality of jaw elements disposed about the first axis in spaced relation to each other and movable toward and away from the first axis;

wherein the jaw elements are movable toward and away from the first axis in response to movement of the first and second grip sections toward and away from each other, respectively;

a lock mechanism comprising:

a lock element movably disposed in the first handle;

an actuator mounted for rotational movement about the first axis, the actuator having a peripheral cam surface eccentrically disposed relative to the first axis and selectively engagable against a lock element;

wherein the wrench is configured such that a spacing between the jaw elements is variably controlled based on a rotational position of the actuator relative to the first axis.

2. The wrench of claim 1, wherein the wrench is configured such that the maximum spacing between the jaw elements is variably controlled based on the rotational position of the actuator such that:

a maximum distance from a first jaw element of the plurality of jaw elements to the first axis is limited to a first amount with the actuator in a first position;

the maximum distance from the first jaw element to the first axis is limited to a second amount, smaller than the first amount, with the actuator in a second position;

wherein the lock element contacts the cam surface at a position farther from the first axis with the actuator in the second position than with the actuator in the first position.

3. The wrench of claim 1:

wherein the first handle comprises:

a plurality of arcuate first guide slots disposed about the workpiece-receiving opening and outboard thereof;

a first lock slot disposed in spaced relation to the workpiece-receiving opening;

wherein the second handle comprises:

a plurality of straight second guide slots joining with the workpiece-receiving opening and extending radially outward therefrom;

a second lock slot disposed in spaced relation to the workpiece-receiving opening;

wherein the jaw elements are movable in the second guide slots toward and away from the first axis in response to movement of the first and second grip sections toward and away from each other, respectively;

wherein the lock element is movably disposed in the first and second lock slots, the lock slots distinct from the guide slots.

4. The wrench of claim 1 wherein the plurality of jaw elements is an even number of jaw elements.

5. The wrench of claim 1 further comprising a spring biasing the grip sections away from each other.

6. A lockable grip wrench, comprising:

a first handle having a first grip section and a first working section;

a second handle having a second grip section and a second working section; the second handle rotatably mounted to the first handle such that the first and second working sections overlap and the first and second handles are rotatable relative to each other about a first axis;

a workpiece-receiving opening extending through the first and second handles and peripherally surrounding the first axis;

the first handle having:

a plurality of arcuate first guide slots disposed about the workpiece-receiving opening and outboard thereof;

a first lock slot disposed in spaced relation to the workpiece-receiving opening;

the second handle having:

a plurality of outwardly extending second guide slots oriented toward the workpiece-receiving opening;

a second lock slot disposed in spaced relation to the workpiece-receiving opening;

a plurality of jaw elements disposed about the first axis in spaced relation to each other, the jaw elements movable in the second guide slots toward and away from the first axis in response to movement of the first and second grip sections toward and away from each other, respectively, such that movement of the first and second grip sections toward each other causes the jaw elements to be displaced toward the first axis, while movement of the first and second grip sections away from each other causes the jaw elements to be displaced away from the first axis;

a lock mechanism comprising:

a lock element disposed generally parallel to the first axis and movably disposed in the first and second lock slots, the lock slots distinct from the guide slots;

an actuator selectively engagable against the lock element at a plurality of positions;

wherein the wrench is configured such that a spacing between the jaw elements is variably controlled based on a position of the actuator.

7. The wrench of claim 6, wherein the wrench is configured such that the maximum spacing between the jaw elements is variably controlled based on the position of the actuator such that:

a maximum distance from a first jaw element of the plurality of jaw elements to the first axis is limited to a first amount with the actuator in a first position;

the maximum distance from the first jaw element to the first axis is limited to a second amount, smaller than the first amount, with the actuator in a second position;

wherein the lock element contacts the actuator at a location farther from an axis of rotation of the actuator with the actuator in the second position than with the actuator in the first position.

8. The wrench of claim 6 wherein the plurality of jaw elements is an even number of jaw elements.

9. The wrench of claim 6 further comprising a spring biasing the grip sections away from each other.

10. The wrench of claim 6:

wherein the actuator is rotatable about the first axis and has a peripheral cam surface eccentrically disposed relative to the first axis;

wherein the wrench is configured such that, based on a rotational position of the cam surface relative to the first axis, the following are variably controlled:

the spacing between the jaw elements;

a position of the lock element along the first lock slot;

a position of the lock element along the second lock slot.

11. A lockable grip wrench, comprising:

a first handle having a first grip section and a first working section;

a second handle having a second grip section and a second working section; the second handle rotatably mounted to the first handle such that the first and second working sections overlap and the first and second handles are rotatable relative to each other about a first axis;

a workpiece-receiving opening extending through the first and second handles with the first axis extending through the workpiece-receiving opening;

a plurality of jaw elements disposed about the first axis in spaced relation to each other and movable toward and away from the first axis;

wherein the jaw elements are movable toward and away from the first axis in response to movement of the first and second grip sections toward and away from each other, respectively;

a lock mechanism comprising:

a lock element movably disposed in both a lock slot of the first handle and a lock slot of the second handle;

an actuator moveable relative to the lock element and the first and second handles; the actuator having a cam surface;

wherein, with the actuator in a locking position, the cam surface limits movement of the lock element toward the first axis to thereby limit movement of the jaw elements away from the from the first axis.

12. The locking grip wrench of claim 11:

wherein the wrench is configured such that a maximum distance between a first jaw element of the plurality of jaw elements and the first axis is variably controlled based on the rotational position of the actuator such that:

the maximum distance is limited to a first amount with the actuator in a first position;

the maximum distance is limited to a second amount, smaller than the first amount, with the actuator in a second position;

wherein the lock element contacts the cam surface at a position farther from the first axis with the actuator in the second position than with the actuator in the first position.

13. The wrench of claim 11:

wherein the first handle comprises a plurality of arcuate first guide slots disposed about the workpiece-receiving opening and outboard thereof and distinct from of the lock slot of the first handle;

wherein the second handle comprises a plurality of outwardly extending second guide slots oriented toward the workpiece-receiving opening; the second guide slots distinct from the lock slot of the second handle;

wherein the jaw elements are movable in the second guide slots toward and away from the first axis in response to movement of the first and second grip sections toward and away from each other, respectively.

14. The wrench of claim 11 wherein the plurality of jaw elements is an even number of jaw elements.

15. The wrench of claim 11 further comprising a spring biasing the grip sections away from each other.

16. A method of operating a manually-powered wrench, comprising:

moving grip sections of first and second handles toward each other to cause a plurality of jaw elements mounted in the handles to move toward an axis about which the first and second handles rotate relative to each other;

establishing a limit of movement of a plurality of jaw elements in a direction away from the axis by rotating a lock actuator about the axis to a locking position; wherein, in the locking position, a cam surface of the locking actuator is positioned in the path of a movable locking pin, the locking pin extending into both the first and second handles.

17. The method of claim 16 further comprising applying torque to a workpiece by rotating the wrench about the axis while the lock actuator is in the locking position.

18. The method of claim 16 wherein rotating the lock actuator to the locking position comprises abutting a cam surface against the locking pin.

19. The method of claim 16:

wherein the second handle comprises a lock slot along which the locking pin is slidable;

wherein the rotating the lock actuator to the locking position comprises positioning the lock actuator so as to inhibit movement of the locking pin along the lock slot toward the axis beyond the cam surface.

* * * * *